US006101772A

United States Patent [19]

Leonard et al.

[11] Patent Number: 6,101,772

[45] Date of Patent: Aug. 15, 2000

[54] WINDOW-MOUNTING DEVICE

[75] Inventors: Kenneth E. Leonard, Warren; Ronald Fischer, Cortland, both of Ohio

[73] Assignee: Dinesol Plastics, Inc., Niles, Ohio

[21] Appl. No.: 09/256,055

[22] Filed: Feb. 23, 1999

[51] Int. Cl.[7] ..... E06B 1/04

[52] U.S. Cl. ..... 52/204.53; 52/208; 52/212; 52/656.5

[58] Field of Search ..... 52/205, 208, 212, 52/204.53, 204.54, 475.1, 646.5, 775

[56] References Cited

U.S. PATENT DOCUMENTS

| | | | |
|---|---|---|---|
| 1,842,285 | 1/1932 | Place . | |
| 2,645,827 | 7/1953 | Koll . | |
| 3,340,663 | 9/1967 | Collard | 52/212 X |
| 3,769,769 | 11/1973 | Kohl | 52/212 |
| 4,280,309 | 7/1981 | Huelsekopf | 52/204.54 |
| 4,351,137 | 9/1982 | Enyart et al. | 52/656.5 X |
| 4,407,100 | 10/1983 | Huelsekopf | 52/204.54 |
| 4,861,540 | 8/1989 | Nieboer . | |
| 4,948,089 | 8/1990 | Knodel . | |
| 5,189,862 | 3/1993 | Lafleur | 52/775 X |
| 5,369,922 | 12/1994 | Hansen . | |
| 5,596,852 | 1/1997 | Schiedegger | 52/212 |
| 5,608,978 | 3/1997 | Sawyer et al. . | |
| 5,644,881 | 7/1997 | Neilly | 52/656.5 X |

FOREIGN PATENT DOCUMENTS

3117046 A1 11/1982 Germany .

*Primary Examiner*—Beth A. Stephan
*Assistant Examiner*—Brian E. Glessner
*Attorney, Agent, or Firm*—Robert G. Lev

[57] ABSTRACT

A mounting device for holding a first panel within an aperture in a second panel includes two frames. The first frame has subconnectors with hook structures. The second frame is formed as a U-shape with flanges extending at angles greater than 90° from the arms of the U-shape. When the two frames are connected to each other by virtue of the interaction of the hook structures and apertures in the arms of the U-shaped structure, the U-shaped structure exerts spring-like pressure on both the wall panel and the window being held within the wall panel.

10 Claims, 2 Drawing Sheets

WINDOW-MOUNTING DEVICE

TECHNICAL FIELD

The present invention relates generally to devices for mounting windows or other structures such as instrument faces in panel walls. In particular, the present invention is directed to a device for removeably mounting a window in a garage door.

BACKGROUND OF THE INVENTION

There are many applications requiring the use of a window to be mounted within an aperture in a panel surrounding the window. The most common example is the use of windows in panel doors such as garage doors, or other normally solid doors. Another example is the mounting of recording instruments with glass-covered dials or displays to be arranged within apertures in solid panels. Still another application is the use of decorative devices placed within apertures of panels and back-lit to further enhance the decorative qualities of the materials in the aperture.

In any of these applications the devices for holding the window (or other structure) within the aperture of the panel must be rugged and easy to use. In some instances, low cost is especially important while in other applications a pleasing or decorative appearance is essential. In still other applications, the mounting device must be impervious to atmospheric conditions, including moisture, sunlight and extremes in temperature. Unfortunately, there are certain drawbacks in the conventional art relating to the installation of windows and the like within solid panels.

For example, in U.S. Pat. No. 2,645,827 to Koll, a complex cut-out is required in order to accommodate a plurality of tongues which are used to hold a mounting frame to the surrounding panel. Consequently, the mounting of windows using this system is time-consuming and difficult. Further, if the precise pattern and the notches is not achieved, there could be substantial difficulties in using the mounting frame of Koll. Because of the complexity of the cut-out pattern, mis-cuts become far more likely than with a simple aperture cut-out pattern. As a result, a mistake that could result in the destruction of the panel is likely with the Koll mounting device.

When using the device of U.S. Pat. No. 5,369,922 to Hansen, a simple aperture cut out pattern can be used, thereby avoiding the drawbacks of the Koll device. In the arrangement of Hansen, a frame member is integral with a first frame and attached to cover the core of the wall (in which a window is to be mounted). The frame member includes a plurality of pairs of ribs. Each pair is connected by a strip to form an elongated opening therebetween. A second frame includes a connection device consisting of elongated tongues providing with toothing and arranged in a longitudinal direction along the frame. The use of the device includes clipping together the two frames from each side of the wall (in which the window is to be mounted). The second frame, and the side toothings on each tongue cooperate with the toothings on corresponding or complementary pair of ribs on the other frame to in order to hold the two frames together. The strength of this arrangement is that it is highly tamper resistant.

However, the mounting device of Hansen is not removable. Further, the slightest distortion of the Hansen device may render it unfit for use since the alignment between the toothed tongues on one frame and elongated openings on the other frame must be very precise. Another drawback of the Hansen device is the relatively small flexible sealing lips that are used to hold the window panes. If the sealing lips are sufficiently rigid to firmly hold the window pane, a loss of flexibility, ease of use, and durability of the overall device occurs. If, on the other hand, the moderately short sealing lips are relatively flexible, the window pane may not be held in a sufficiently firm manner, thereby leading to other difficulties.

Consequently, there is still a need to provide a mounting device for holding a window within a wall panel where the holding device is sufficiently flexible to accommodate the variations that constantly occur in the field while still sufficiently rigid to tightly hold window panes within the wall panel. In order to be useful in the field, such a device must be easy to use, and have a resilient, robust structure for which operation is not undermined by rough use or deformation occurring during the mounting process. Such a device should also be sufficiently flexible in it's operation that it can accommodate easy refitting to a panel aperture.

SUMMARY OF THE INVENTION

Accordingly, it is the object of the present invention to provide a mounting device that overcomes the drawbacks of the conventional art.

It is another object of the present invention to provide a mounting device that is easily removable from only one side, thereby making the device highly tamper resistant from the other side (presumably the exterior of a wall).

It is a further object of the present invention to provide a window mounting device that is easy to use, and requires only a simple cut-out.

Still another object of the present invention is to provide a mounting device for a window or instrument within a wall panel that can be installed quickly and efficiently.

It is yet a further object of the present invention to provide a mounting device to be quickly assembled by means of a simple snap engagement.

It is yet a further object of the present invention to provide a mounting device that is easily adaptable to a variety of window and panel thicknesses.

It is still another object of the present invention to provide a window mounting device that exerts a spring-like pressure on a window pane being held in an aperture within a wall, thereby creating a tight seal around the window pane.

It is again a further object of the present invention to provide a mounting system capable of accommodating different structures in an aperture within a wall panel.

These and other goals and objects of the present invention are achieved by a mounting device for holding a first panel within an aperture in a second panel. The mounting device includes a first frame having a first substantially planer base structure arranged to overlap both the first and second panels. The first frame also has a plurality of connector studs extending substantially perpendicular to the planer base structure. Each of the connector studs has a hook structure extending perpendicular to a major plane of the connector stud. The mounting device also includes a second frame configured to complement the first frame. The second frame is constituted by a substantially U-shaped structure having two arms. Each arm has a distal end (opposite the shoulder of the U-shape) with a flange extending outwardly from each of the distal ends. The flanges are arranged to overlap either the first panel or the second panel. The U-shape structure also has a plurality of apertures arranged on the arms to accommodate complementary hook structures. The U-shape structure and the flange exerts spring-like pressure against the first panel and the second panel when the first and second frame are connected together by virtue of a hook extending into the complementary aperture.

BRIEF DESCRIPTION OF THE DRAWINGS

FIG. 2(*b*) is a side view diagram of the second frame constituting the present invention.

DETAILED DESCRIPTION OF THE PREFERRED EMBODIMENTS

Figure 1:
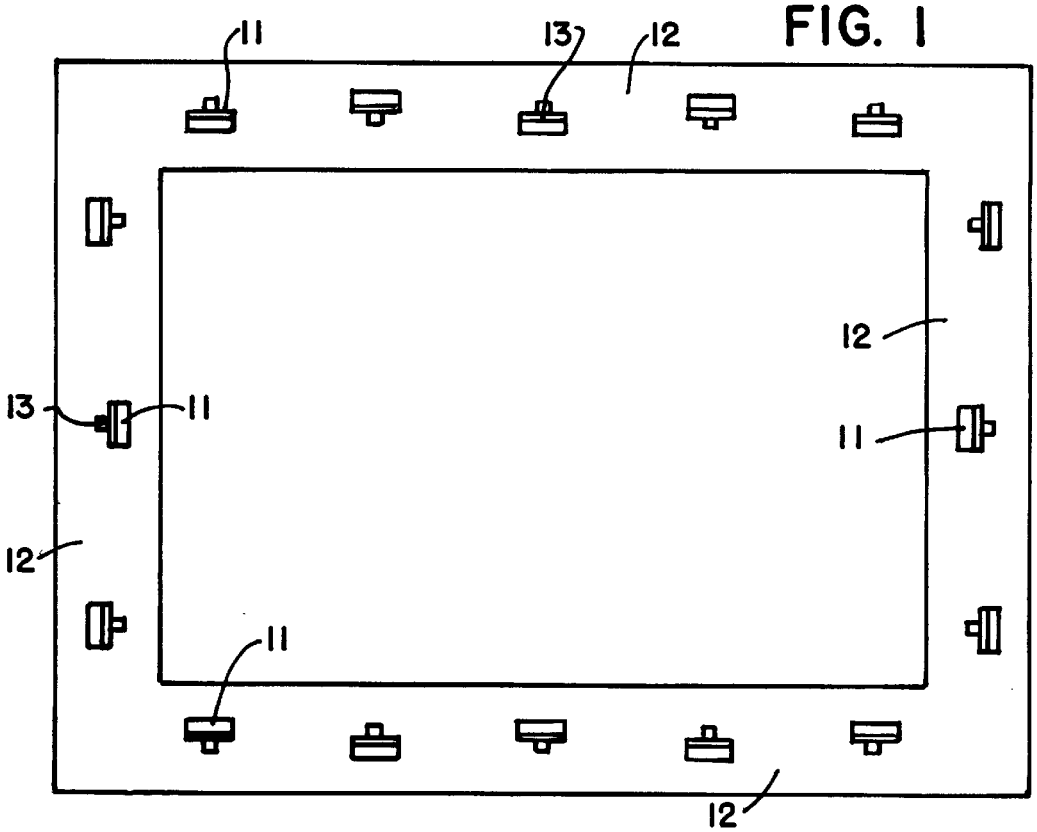
FIG. 1 is a top view diagram of the first frame constituting the present invention.
Figure 2A:
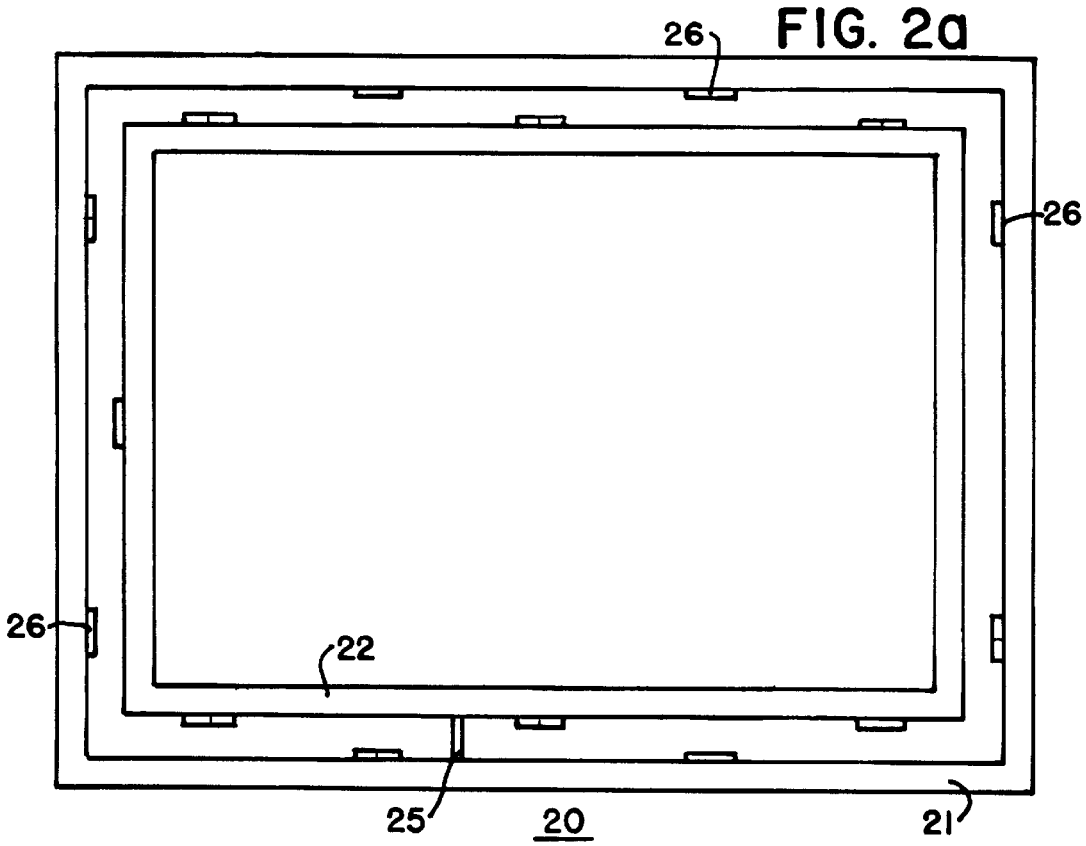
FIG. 2(*a*) is a bottom view diagram of the second frame constituting the present invention.
Figure 2B:
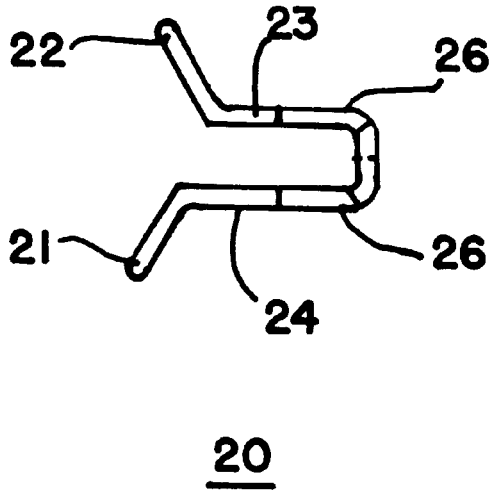

A preferred embodiment of the present invention is depicted in FIGS. 1 and 2(*a*) as being rectangular in shape. This shape conforms with the most common shape of windows that are placed in wall panels such as those in garage doors. However, the shape of the present invention is not limited to a rectangle. Rather, the present invention can be used in any size or shape of window or other structure which is to be mounted within an aperture formed in a solid panel or wall. It should be noted that while the preferred embodiment of the present invention is adapted specifically for uninsulated garage doors, it can be used for insulated garage doors, entry doors in dwellings (both solid and hollow core), as well as wall panels of a number of different types of materials. Thus, the present invention is not limited to a pane of glass placed within a wooden or metal garage door panel, even though the dwellings and the dimensions used are preferably used in this particular application. Preferably, the connecting device is made of a resilient but moderately rigid plastic. However, fiberglass can also be used, as can any metal having spring-like characteristics. The requirements for the materials constituting the present invention is that they be sufficiently rigid to laterally support a window pane within a wall panel, yet be sufficiently resilient so as to provide spring-like action on the window pane as will be described infra. Consequently, hard rubber or nylon can be used to constitute the present invention. Further, a combination of materials can also be used, depending upon the size of the aperture, size and constitution of the wall panel and the size and constitution of the structure to be held within the aperture. For example, the outer frame 10 can be made of a rigid nylon material while the inner frame 20 (as depicted in FIG. 2(*a*)) can be constituted by a softer or more flexible material to better grip the window pane or other structure that is to be mounted within the aperture in the wall panel. Further, separate portions of the two frames 10, 20 can be constituted of different materials. However, the most efficient manner of constructing the present invention is to use a single injection-molded plastic.

FIG. 1 depicts the outer or exterior frame 10, that is used on the exterior side of the wall panel (now shown). The bottom surface of frame 10 is depicted as surface 17 in FIG. 3, and presents a smooth, solid, highly tamper-resistant surface for an exterior side of the wall panel in which the window (not shown) is held by the present invention.

The depicted example of the outer wall frame 10 approximately 6 inches by 8 inches for the outside dimensions. The width of each of the planar structure 12 legs of the outer frame 10 is approximately 0.875 inches. The planer structure 12 which includes the majority of the material of lower or outer frame 10 is approximately 0.1 inch thick. It should be understood that these exemplary dimensions can be altered in any way that can be conceived by a skilled practitioner in this technology, and is limited only by the characteristics of the materials used to constitute the inventive mounting device.

The two frames, 10,20 are connected together by means of connecting studs 11. In the preferred embodiment, these are arranged with approximately 1 inch intervals spaced between them. However, different spacings can be used while maintaining the operating concept of the present invention. The two frames are connected together by virtue of the studs 11 interfacing with apertures 26 within the sidewalls 23,24 (as depicted in FIG. 2(*b*)).

Figure 3:
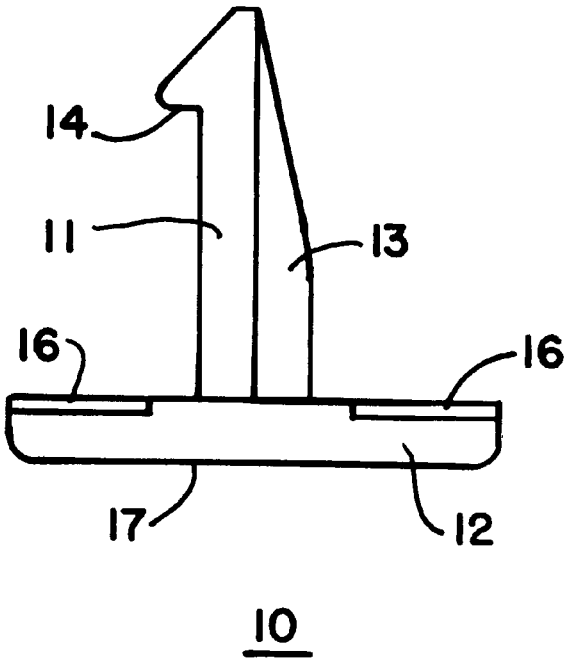
FIG. 3 is a detailed cross-sectional view diagram of the first frame constituting the present invention.

The connecting studs 11 hold frame 10 to frame 20 by virtue of hook structures 14 extending through apertures 26 in both arms 23 or 24. As shown in FIG. 2(*a*) the apertures 23 and 24 alternate along the length of inner frame 20. As depicted in FIG. 3, the connecting studs are approximately 0.7 inches long from the base of the planer structure 12 to the tip of the stud. Connecting stud 11 holds inner frame 20 by virtue of barbed hook structure 14 which extends through apertures 26 when the two frames are connected. The connecting stud 11 is reinforced by a rib 13 which is arranged perpendicular to the plane of the major surface of the connecting stud. The reinforcing rib 13 runs for almost the entire length of the connecting stud 11. As depicted in FIG. 3, support rib 13 is configured to have a reduced width near the top of connecting stud 11. At it's widest portion, support rib 13 is approximately 0.1 inches thick as depicted in the example of FIG. 3. The barber hook structure 14 has a lower portion that extends approximately parallel to the planer structure 12 and an upper portion that extends at approximately a 45° angle from the point of the barbed hook.

The inner or interior frame 20 is a U-shaped structure as depicted in FIG. 2(*b*). In the example provided, the height of the U-shaped structure is approximately 0.85 inches from the top of the shoulder of the U-shape to the bottom of flanges 21 and 22, which extend from the arms 23, 24 at an angle of greater than 90°. In the example presented, the length from the top of the U-shape structure to the end of each flange 21, 22 is different. This asymmetrical arrangement accommodates differences in window thickness and wall panel thickness. The angle and the ultimate length of each of the flanges 21, 22 can be adjusted based upon the thickness of both the wall panel and the window to be contained in the aperture of the wall.

A key feature of the present invention is the use of a resilient material to constitute inner frame 20. As a result, when frame 20 is forced against the panel and the window, the entire U-shaped structure flexes to provide spring-like tension against both the window and the wall panel. The height of apertures 26 along arms 23, 24 is adjusted so that a predetermined spring tension will result when the two frames 10, 20 are connected together by virtue of the hook structures 14 interfacing with apertures 26. By flexing the entire U-shaped structure of frame 20, the mounting apparatus becomes more resilient and has a much greater useful life span. Further, one of the drawbacks of the conventional art, a relatively high amount of tension on a relatively short flange, is eliminated by spreading the tension over the entire U-shaped structure. The flexing of the entire U-shaped structure relieves the localized pressure that might cause a relatively short, single portion of a conventional mounting frame to fail.

The flexability of the U-shaped structure of FIG. 2(*b*) can be adjusted in a number of different ways. In the preferred embodiment, a rib structure 25 is placed at periodic intervals between arms 23, 24. As a result, the U-shaped structure can be made of a relatively resilient (as opposed to stiff) material. A flexing of the arms 23,24 of the U-shaped structure will be limited and thus appear relatively stiff while the flanges 21,22 will flex easily to more efficiently grip the window and the wall panel being held by the device. By using ribs 25, frame 20 can be made of a uniform material while achieving different flexibility for different parts of the structure. In this manner, a single material can be used for making the frame 20, which is preferably made by injection mold and a plastic. This is an inexpensive and relatively simple process, and thus, is considered more desirable than the use of other materials and other manufacturing processes.

The connections between the connecting studs 11 and apertures 26 are arranged to be on the interior side of the panel which holds the window. There are no connections between the two frames on the exterior side. Rather, only the smooth surface 12 is accessible from the exterior of the wall panel in which the mounting device is used. As a result, the mounting device is highly tamper-resistant. However, the mounting device constituted by frames 10 and 20 removable from the interior of the wall panel. Separation of the two frames is carried out simply by pushing the hook structures 14 of connecting studs 11 back through apertures 26. Once this has been done, there is nothing to hold the two frames to each other, and they separate easily. The removeability of the present invention allows a high degree of flexibility to accommodate different window thickness and wall panel thicknesses, as well as irregularities in the cut out or apertures in which the window is to be installed.

The inventive mounting device has the capability of accommodating an increased range of windows by making alterations in the size and the shape of the detents 16 (as depicted in FIG. 3). The detents can be adjusted by manually shaving the planer structure 12, or by forming the detents as part of the overall molding process in which frame 10 is manufactured. The use of detents 16 allow the use of frame materials that are somewhat more pliable and might not be practical without the use of the detents.

Although a number of embodiments have been described by way of example, the present invention is not limited thereby. Accordingly, the present invention should be construed to include any and all variations, permutations, modifications, adaptations and embodiments that would occur to one skilled in this technology once having been taught the present invention by this application. Therefore, the present invention should be construed as being limited only by the following claims.

We claim:

1. A mounting device for holding a first panel within an aperture in a second panel, said mounting device comprising:

(a) a first frame having a first substantially planer base structure arranged to overlap said first and second panels, and a plurality of connector studs extending substantially perpendicular to said planer base structure, each said connector stud having a hook structure extending perpendicular to a major plane of said connector stud;

(b) a second frame configured to complement said first frame, said second frame comprising (i) a substantially U-shaped structure having two arms, each arm having a distal end;

(ii) flanges extending outwardly from each of said distal ends and arranged to overlap one of said first panel and said second panel;

(iii) a plurality of apertures arranged on said arms to accommodate complementary hook structures;

(c) whereby said U-shaped structure and said flanges exert spring-like pressure against said first panel and said second panel when the first and second frames are connected together by virtue of said hooks extending to said complementary apertures.

2. The mounting device of claim 1, wherein said flanges extend outward from said arms at angles greater than 90°.

3. The mounting device of claim 2, wherein said frames comprise plastic.

4. The mounting device of claim 2, wherein said frames comprise a metal having spring-like characteristics.

5. The mounting device of claim 2, wherein said frames comprise fiberglass.

6. The mounting device of claim 2, wherein said frames comprised of rubber.

7. The mounting device of claim 2, further comprising a plurality of ribs connecting said first and second arms on said second frame.

8. The mounting device of claim 2, wherein said first frame further comprises rebates for said first and second panels.

9. The mounting device of claim 2, wherein said connector studs comprise two flat major surfaces with said hook structure extending from one of said major surfaces and a support rib extending from said other major surface.

10. The mounting device of claim 2, wherein said complementary apertures are arranged alternately on opposite arms of said U-shaped structure.

* * * * *